US008173555B2

(12) United States Patent
Chang et al.

(10) Patent No.: US 8,173,555 B2
(45) Date of Patent: May 8, 2012

(54) COLOR-COATED, FOULING-RESISTANT CONDUCTIVE CLOTH AND MANUFACTURING METHOD THEREOF

(75) Inventors: Feng-Chang Chang, Touliu (TW); Hsin-Feng Cho, Touliu (TW); Jian-Wen Cheng, Touliu (TW)

(73) Assignee: Formosa Taffeta Co., Ltd., Touliu (TW)

( * ) Notice: Subject to any disclaimer, the term of this patent is extended or adjusted under 35 U.S.C. 154(b) by 1221 days.

(21) Appl. No.: 11/850,728

(22) Filed: Sep. 6, 2007

(65) Prior Publication Data

US 2008/0057815 A1 Mar. 6, 2008

(30) Foreign Application Priority Data

Sep. 6, 2006 (TW) ..... 95132884 A

(51) Int. Cl.

| | |
|---|---|
| ***B32B 5/02*** | (2006.01) |
| ***D06N 7/04*** | (2006.01) |
| ***B44C 5/04*** | (2006.01) |

(52) U.S. Cl. ..... 442/110; 428/143; 428/148; 428/418; 428/922; 442/66

(58) Field of Classification Search ..... 442/66, 442/68, 110–111; 428/418, 141, 147, 148, 428/143

See application file for complete search history.

(56) References Cited

FOREIGN PATENT DOCUMENTS

| | | | |
|---|---|---|---|
| JP | 61/245372 | * | 4/1985 |
| JP | 61245372 | * | 10/1986 |
| JP | 11346089 | | 12/1991 |
| JP | 4048697 | | 2/1992 |
| WO | WO 02/18700 | * | 3/2002 |

* cited by examiner

*Primary Examiner* — Lynda Salvatore

(74) *Attorney, Agent, or Firm* — Connolly Bove Lodge & Hutz LLP

(57) ABSTRACT

The present invention relates to a color-coated fouling-resistant conductive cloth and a manufacturing method thereof. The method includes the steps of providing a conductive cloth interwoven by natural fibers or artificial fibers and containing a metal layer, and forming at least one colored resin-coating layer on the metal layer of the conductive cloth by means of blade coating, wherein the surface of the resin-coating layer does not exceed the intersections of warp yarns and weft yarns of the conductive cloth. The conductive cloth of the present invention has the characteristics of colored appearance, artificial or environmental contamination resistance, and low surface resistance.

4 Claims, No Drawings

COLOR-COATED, FOULING-RESISTANT CONDUCTIVE CLOTH AND MANUFACTURING METHOD THEREOF

RELATED APPLICATIONS

This application claims benefit of Taiwanese application 095132884 filed Sep.6 2006.

BACKGROUND OF THE INVENTION

1. Field of the Invention

The present invention relates to a technical field of conductive cloth, and more particularly to a color-coated, fouling-resistant conductive cloth with low surface resistance and a manufacturing method thereof.

2. Description of the Prior Art

Generally, the current conductive cloth is formed by performing electroless plating to form metallized fabrics. When plating copper, the conductive cloth has a metallic copper appearance, when plating copper and nickel, the conductive cloth is silvery gray, when plating silver, the conductive cloth is silvery white, or when plating gold, the conductive cloth is golden. The conductive cloth is soft, smooth, and gas permeable, and has the advantages of being lightweight and easily cut. However, due to the metallization effect on the surface of the conductive cloth, the conductive cloth cannot be dyed through using the dyeing technique for common cloth. Therefore, compared with the common cloth with various colors, the appearance of the conductive cloth is relatively dull and is limited in application.

Furthermore, as the surface of the conductive cloth is formed by a metal layer, such as copper, nickel, silver, or gold, it is likely to be influenced by the environmental temperature and humidity, and to be affected by hand traces or other contacts during operation, thus resulting in defects, i.e., oxidation, hand traces, contaminated appearance, or raised surface resistance.

It is known in the prior art that the polyurethane resin or acrylic resin with conductive carbon black is coated on the conductive cloth, so as to get a conductive cloth having a black conductive coating layer. As the coated carbon black is thick, and the conductivity of the carbon black is about 1Ω to about 1000Ω, the conductive cloth having the carbon black coating layer cannot maintain the same low surface resistance as the original conductive cloth. Generally, the surface resistance of the conductive cloth is about 0.007Ω/□ to about 1Ω/□. In addition, the blackness of the carbon black is too dull to exhibit a bright shade of blackness, and what's worse; there is merely a single choice of black, which severely restricts applications of the product.

Since the current conductive cloth has color restriction defects and is easily influenced by the environment, it is necessary to improve the current conductive cloth.

SUMMARY OF THE INVENTION

In order to eliminate the restrictions and defects of the current conductive cloth, one object of the invention is to provide a color-coated conductive cloth, capable of preventing artificial or environmental contamination from influencing the characteristics thereof, and maintaining the original low surface resistance.

Another object of the invention is to provide a method of manufacturing a color-coated, fouling-resistant conductive cloth. The method includes the steps of providing a conductive cloth interwoven by natural fibers or artificial fibers and containing a metal layer; and forming at least one colored resin-coating layer on the metal layer of the conductive cloth, wherein the surface of the resin-coating layer does not exceed intersections of warp yarns and weft yarns of the conductive cloth.

DETAILED DESCRIPTION OF THE INVENTION

In a specific embodiment of the present invention, a method of manufacturing a color-coated, fouling-resistant conductive cloth includes steps of providing cloth interwoven by natural fibers or artificial fibers; coating a metal layer uniformly on the surface of the cloth through electroless plating, so as to get a conductive cloth; formulating a pigment and a resin into a color resin coating formulation; and coating a thin coating layer of at least one color resin on the metal layer of the conductive cloth. Take the coating step as an example, coat one to four layers to adjust the shade of the color for the coating layer, and each coating layer is coated on the recessed regions of the cloth but does not exceed the intersections of warp yarns and weft yarns of the cloth. During the coating step, some of the formulation may be coated on the intersections of warp yarns and weft yarns of the cloth, but will not affect the properties of the conductive cloth.

The natural fibers used in the method can be any natural fiber, for example, but not limited to, cotton, hemp, silk, or wool; and the artificial fibers can be any artificial fiber, for example, but not limited to, rayon fiber, nylon fiber, polyester fiber, or acrylic fiber.

The electroless plating process is well known to those skilled in the art, and in it, the metal used can be any metal with desirable conductivity, for example, but not limited to, copper, nickel, silver, gold, or an alloy thereof.

The pigment used in the method can be dyes of any color, for example, carbon black, pigments of organic black, red, blue, green, or gold, or obtained by formulating dyes of any desired color. The usage amount of the pigment is about 1% to about 20% of the resin coating formulation. The resin can be a solvent-based resin or an aqueous resin, for example, but not limited to, polyurethane resin, polyester resin, acrylic resin, latex resin, or silicone resin. The usage amount of the resin is about 10% to about 70% of the resin coating formulation.

In a preferred embodiment of the present invention, the following additives can be optionally added to the resin coating formulation: a cross-linking agent, for example, but not limited to, isocyanate or melamine, with an amount of about 1% to about 10% of the resin coating formulation; a solvent, for example, but not Limited to, toluene, methyl ethyl ketone (MEK), dimethylformamide (DMF), with an amount of about 30% to about 60% of the resin coating formulation, so as to dilute the resin coating formulation to a viscosity of about 1000 cps to about 20,000 cps.

In the above method, the process of coating the thin coating layer of color resins is well known to those skilled in the art, for example, but not limited to, blade coating, engraved roller coating, spraying coating, or dipping and padding, together with a scraper to scrape off the redundant resin on the surface, so as to form the thin coating layer.

In a preferred embodiment of the present invention, the blade coating process can be suspension blade coating, so as to accurately control the coating amount of each coating layer. In a preferred embodiment of the present invention, the scraper can be a J-shaped scraper or a U-shaped scraper, and has a thickness of about 0.5 mm to about 5 mm. The contact area for the scraper once the scraper is pressed on the conductive cloth is about 0.5 mm to about 20 mm. The coating amount for each time is about 0.1 g/M$^2$ to about 8 g/M$^2$, and then after coating, the cloth is dried at about 80° C. to about 160° C. for about 1 min to about 3 min.

The present invention further provides a color-coated, fouling-resistant conductive cloth, which includes a conductive cloth, interwoven by natural fibers or artificial fibers and containing a metal layer; and at least one colored resin-coating layer, coated on the metal layer of the conductive cloth through blade coating, wherein the surface of the resin-coating layer does not exceed the intersections of warp yarns and weft yarns of the conductive cloth. The surface resistance of the conductive cloth before being coated with the colored resin-coating layer is about 0.007Ω/□ to about 0.1Ω/□, and the surface resistance after being coated with colored resin-coating layer is about 0.007Ω/□ to about 0.1Ω/□.

According to the present invention, a relatively lower amount of coating is applied and the coating layer formed through multiple coating processes does not exceed the intersections of warp yarns and weft yarns of the conductive cloth, so as to present a desired color on a single surface or double surfaces of the conductive cloth, so that the conductive cloth exhibits an appearance with an uniform color and shade of the color. Furthermore, the appearance and conductivity of the metal layer on the surface of the conductive cloth are not influenced by artificial or environmental contaminations due to the protection of the thin resin-coating layer. The color-coated conductive cloth still has the same surface conductivity as that of the original conductive cloth, and the surface resistance is not increased due to the excessively thick coating layer.

The conductive cloth of the present invention has the characteristics of colored appearance, artificial or environmental contamination resistance, and low surface resistance. The conductive cloth of the present invention can be made into conductive cloth tapes, conductive cloth foams, or conductive cloth pads after being coated with or after adhering the latter to them, conductive pressure-sensitive adhesives or heat-melting adhesives. In addition, the conductive cloth of the present invention can have the anti-radiation and antistatic properties, so that it can prevent electromagnetic waves leaking from the electronic machine from affecting the electronic machine itself or other electronic machines and causing incorrect operations thereby.

The examples given below are intended to be illustrative only and not to be limitations of the invention. Any modifications and variations that can be easily made by those skilled in the art fall within the scope of the disclosure of the specification and the appended claims of the present invention.

EXAMPLE 1

Preparation of a Color-Coated, Fouling-Resistant Conductive Cloth

The color-coated, fouling-resistant conductive cloth is prepared through the following steps.

Interweaving: Plainweave cloth with a thickness of 0.1 mm is interwoven by polyester fibers, which has warp yarns 50 denier/36 filaments, weft yarns 50 denier/72 filaments, warp density 152 yarns/inch, and weft density 124 yarns/inch.

Electroless plating: After the scouring and cleaning, thermal setting, surface roughening, and surface adjusting processes, the cloth is electroless plated with copper and nickel for metallization.

The electroless plating process is well-known to those skilled in the art, and includes the following steps: firstly, activating: at 30° C., the cloth is immersed in a solution of 100 mg/L palladium chloride, 10 g/L stannous chloride, and 100 ml/L hydrochloric acid for 3 min, and then washed completely; next, acceleration: at 45° C., the cloth is immersed in 100 ml/L hydrochloric acid for 3 min, and then washed completely; and then, electroless plating of copper: at 40° C., the cloth is immersed in a solution of 10 g/L copper sulfate, 7.5 ml/L formaldehyde, 8 g/L sodium hydroxide, 30 g/L ethylene diamine tetraacetic acid tetrasodium salt (EDTA-4Na), and 0.25 ml/L stabilizer for 20 min, so as to uniformly plate 25 g/M$^2$ copper on the cloth, and then the cloth is washed completely; and then, electroless plating of nickel: at 40° C., the cloth is immersed in a solution of 22.5 g/L nickel sulfate, 18 g/L sodium hypophosphite, 0.1 M/L sodium citrate, and 20 ml/L ammonia for 5 min, so as to uniformly plate 5 g/M$^2$ nickel on the cloth, and then the cloth is washed completely; finally, the cloth is dried, to get a silvery gray conductive cloth.

Four-point probe test is performed with JIS K-7194, Mitsubish Loresta MCP-T600, wherein the test probe is placed on the surface of the cloth to test the surface resistance, and as a result, the surface resistance of the resultant silvery gray conductive cloth is about 0.03Ω/□.

Preparing the resin coating formulation: 100 g of two-component polyurethane resin, 9 g of isocyanate, 50 g of methyl ethyl ketone, 5 g of carbon black, and 5 g of black pigment (wherein the black pigment contains 32% carbon black, 3% dispersion agent, 20% acrylic resin, and 45% carrier) are mixed to form a bottom coating formulation with a viscosity of about 5000 cps; and 100 g of one-component polyurethane resin, 3 g of isocyanate, 50 g of methyl ethyl ketone, 10 g of carbon black, and 10 g of black pigment (wherein the black pigment contains 32% carbon black, 3% dispersion agent, 20% acrylic resin, and 45% carrier) are mixed to form a surface coating formulation with a viscosity of about 4000 cps.

Blade coating: The formulated resin coating formulation is coated on the metal layer of the conductive cloth through a suspension machine, wherein the machine uses a J-shaped scraper with a thickness of 2 mm and the contact area for the scraper when it is pressed against the conductive cloth is 2 mm. Firstly, about 5 g/M$^2$ of the bottom coating formulation is coated on the conductive cloth to cover the recessed regions of the cloth but not to exceed the intersections of warp yarns and weft yarns of the cloth; next, the cloth is baked at about 120° C. for about 1 min.; and then, about 5 g/M$^2$ of the surface coating formulation is coated on the recessed regions of the cloth but does not exceed the intersections of warp yarns and weft yarns of the cloth; and the cloth is baked at about 120° C. for about 1 min, so as to form a color-coated, fouling-resistant conductive cloth.

COMPARATIVE EXAMPLE 1

Preparation of a Carbon-Coated, Fouling-Resistant Conductive Cloth

The interweaving and electroless plating steps of Example 1 are repeated to form a silvery gray conductive cloth with a surface resistance of about 0.03Ω/□; and then, a resin coating formulation containing conductive carbon black is coated on the metal layer of the conductive cloth. Firstly, a bottom coating layer is formed on the conductive cloth with a bottom resin coating formulation containing 100 g of two-component polyurethane resin, 50 g of methyl ethyl ketone, 9 g of isocyanate, and 5 g of conductive carbon black and having a viscosity of about 5000 cps; next, a surface coating layer is formed on the conductive cloth with a surface resin coating formulation containing 100 g of one-component polyurethane resin, 50 g of methyl ethyl ketone, 3 g of isocyanate, and 10 g of conductive carbon black and having a viscosity of about 4000 cps, and the total thickness of the dry film of the bottom coating layer and the surface coating layer is about 0.08 mm, to get a carbon-coated, grey black fouling-resistant conductive cloth.

The color, thickness, surface resistance, fouling-resistant effectiveness, and shielding effectiveness of the conductive cloth and the uncoated conductive cloth prepared according to Example 1 and Comparative Example 1 are all listed in Table I.

The fouling-resistant effectiveness is tested by taking a conductive cloth that is cut with a cutting warp and weft of 10 cm×10 cm as a sample, for testing the contamination caused by hand traces and residual traces left on the surface of the sample, wherein O indicates almost no contamination traces, Δ indicates fewer contamination traces, and X indicates severe contamination traces.

TABLE I

| | Uncoated Cloth | Comparative Example 1 | Example 1 |
|---|---|---|---|
| Color | Silvery Gray | Grey Black | Deep Black |
| Thickness | 0.1 mm | 0.18 mm | 0.1 mm |
| Surface Resistance | 0.03 Ω/□ | 0.08 Ω/□ | 0.03 Ω/□ |
| Fouling-resistant Effectiveness | X | Δ | ○ |
| Shielding Effectiveness | 80 dB | 80 dB | 80 dB |

To sum up, according to the present invention, through coating a relatively lower amount of coating, together with the color resin coating formulation, conductive cloth is made to exhibit a colored appearances without affecting the surface conductivity of the original conductive cloth, and the conductive cloth also has the characteristics of anti-oxidation, fouling resistance, artificial or environmental contamination resistance, and stable, constant performance, which is helpful for expanding applications of the conductive cloth.

What is claimed is:

1. A color-coated, fouling-resistant conductive cloth, comprising a conductive cloth interwoven by natural fibers or artificial fibers and containing a metal layer, and at least one colored resin-coating layer coated on the metal layer of the conductive cloth by means of blade coating, wherein the surface of the resin-coating layer does not exceed intersections of warp yarns and weft yarns of the conductive cloth, wherein the colored resin-coating layer comprises about 1% to about 20% pigment and about 10% to about 70% resin, and wherein the resin comprises a solvent-based resin or an aqueous resin.

2. The fouling-resistant conductive cloth as claimed in claim 1, wherein the resin comprises polyurethane resin, polyester resin, acrylic resin, latex resin, or silicone resin.

3. A color-coated, fouling-resistant conductive cloth, comprising a conductive cloth interwoven by natural fibers or artificial fibers and containing a metal layer, and at least one colored resin-coating layer coated on the metal layer of the conductive cloth by means of blade coating, wherein the surface of the resin-coating layer does not exceed intersections of warp yarns and weft yarns of the conductive cloth, wherein the colored resin-coating layer comprises about 1% to about 20% pigment and about 10% to about 70% resin, and wherein the colored resin-coating layer further comprises about 1% to about 10% cross-linking agent and about 30% to about 60% solvent.

4. The fouling-resistant conductive cloth as claimed in claim 3, wherein the cross-linking agent comprises isocyanate or melamine, and the solvent comprises toluene, methyl ethyl ketone, or dimethylformamide.

* * * * *